US005454358A

United States Patent [19]

Hattori et al.

[11] Patent Number: 5,454,358

[45] Date of Patent: Oct. 3, 1995

[54] DRIVING POWER CONTROL APPARATUS FOR INTERNAL COMBUSTION ENGINE

[75] Inventors: Tatsuya Hattori, Susono; Masuji Oshima, Kariya; Hiroyuki Yoshida, Inazawa, all of Japan

[73] Assignee: Toyota Jidosha Kabushiki Kaisha, Aichi, Japan

[21] Appl. No.: 200,799

[22] Filed: Feb. 23, 1994

[30] Foreign Application Priority Data

Feb. 26, 1993 [JP] Japan ..... 5-037782
Feb. 26, 1993 [JP] Japan ..... 5-037783

[51] Int. Cl.[6] ..... F02D 11/10

[52] U.S. Cl. ..... 123/399

[58] Field of Search ..... 123/352, 361, 123/399; 180/178, 179; 264/431.04

[56] References Cited

U.S. PATENT DOCUMENTS 4,671,235 6/1987 Hosaka ..... 123/399 X
4,727,838 3/1988 Oshiage et al. ..... 123/399 X
5,133,021 7/1992 Carpenter et al. ..... 382/15
5,200,898 4/1993 Yuhara et al. ..... 123/361 X

FOREIGN PATENT DOCUMENTS 1-294925 11/1989 Japan .
3-235723 10/1991 Japan .
4-314940 11/1992 Japan .

*Primary Examiner*—Tony M. Argenbright
*Attorney, Agent, or Firm*—Kenyon & Kenyon

[57] ABSTRACT

A neural network of a neuro computer has learned a prediction pattern based on the vehicle speed and time series data of the acceleration stroke received before the shipment of a vehicle. Based on the vehicle speed and time series data of the acceleration stroke, a request on the acceleration is predicted by a neural network computer during driving. At this time, an acceleration sensor or the like is not used, and the acceleration request is predicted more directly. Based on the prediction result, the throttle sensitivity is computed and set. A throttle computer refers to the throttle sensitivity to open or close the throttle valve to control the output of the engine.

23 Claims, 11 Drawing Sheets

DRIVING POWER CONTROL APPARATUS FOR INTERNAL COMBUSTION ENGINE

BACKGROUND OF THE INVENTION

1. Field of the Invention

The present invention relates to a driving power control apparatus equipped in an engine of a vehicle. More particularly, this invention relates to an apparatus which controls vehicle driving power in such a way that the vehicle's acceleration is precisely controlled according to the acceleration demands requested by the driver.

2. Description of the Related Art

In general, despite the fact that many vehicles are subject to operation under the same environmental conditions each is manipulated in different ways according to the individual habits of different drivers. Likewise, it is also generally true that drivers demand vehicles having quick response and smooth acceleration. It is well known that the power output of an engine-mounted vehicle is controlled according to how much the driver depresses the accelerator pedal.

For instance, Japanese Unexamined Patent Publication No. Hei 4-314940 discloses the following control technique. This technique allows the angle of the linkless throttle valve (throttle angle) in an engine-mounted vehicle to be controlled in accordance with the thrust amount of the accelerator pedal by the driver (acceleration stroke). Data which determines the target acceleration corresponding to the acceleration stroke is previously stored as a map in a backup RAM. The throttle angle is controlled in such a manner that the actual acceleration of the vehicle comes to the target acceleration determined by this map. Through this control, the driving power of the vehicle is controlled. According to this control technique, a change in acceleration stroke and the actual acceleration are detected as a change in the degree of the acceleration requested by the driver. The data on the map is corrected so as to minimize the difference between the detected degree of the requested acceleration and the target acceleration. The corrected data is stored in the backup RAM again. That is, the compensation (correction) on the target acceleration is performed in accordance with the mentioned difference and the map is rewritten accordingly.

Thus, learning is executed in such a way that the data of the target acceleration matches the acceleration requested by the driver. It is therefore possible to determine the target acceleration which meets the driver's request. As a result, it is always possible to obtain the driving power which matches with the characteristic of the driver, regardless of the mental state of the driver and the driving environment, thus ensuring the desirable driving performance.

According to the above-described control technique, however, the data of the target acceleration is learned simply by compensating (correcting) the data and rewriting the map accordingly. The data of the target acceleration is merely learned just for a certain point or a certain range of the acceleration stroke. Therefore, there occurs a partial unbalance in the rewritten map which has the target acceleration compensated (corrected) only for a specific driving area. This causes partial discontinuity to the relationship formed between the acceleration stroke and the target acceleration in the rewritten map. Consequently, the result of changes made in the accelerator stroke can result in degraded control of the vehicle's driving power.

SUMMARY OF THE INVENTION

Accordingly, it is a primary objective of the present invention to provide a driving power control apparatus for a vehicle, which effects precise driving power control matching the driving characteristics of any particular driver, regardless of his or hers mental state or their driving environment, and which will ensure continuous driving power control over the entire range of the amount of manipulation of the accelerator pedal or the like made by the driver.

It is another objective of the present invention to provide a driving power control apparatus for a vehicle, which will predict the driver's acceleration request by more precise means in order to obtain the driving power that matches the needs required by of the driver and the desirable driving performance, and which is designed to prevent throttle control lag while reducing the manufacturing cost involved in producing acceleration detecting means.

To achieve the foregoing and other objects and in accordance with the purpose of the present invention, there is provided an apparatus for controlling the power output of a motor vehicle by predicting an amount of acceleration requested by the vehicle's operator, and by computing and setting a throttle sensitivity for a throttling apparatus of a power source in said motor vehicle based on said predicted acceleration amount. The apparatus of the present invention includes means for detecting an amount by which said power source is throttled and for producing a throttle signal corresponding thereto, means for manipulating the acceleration of the motor by the vehicle's operator, means for detecting the amount by which said acceleration manipulating means is manipulated and for producing a manipulated accelerator signal corresponding thereto, means for detecting the speed of said vehicle and for producing a speed signal corresponding thereto, means for processing the signals produced by the throttle, manipulated accelerator, and speed detecting means to predict a requested acceleration prediction model, means for storing the signals produced by the throttle, manipulated accelerator, and speed detector means, and said requested acceleration prediction model, means for computing a throttle sensitivity control value from said predicted requested acceleration model, and means for controlling said throttle apparatus based on said throttle sensitivity control value.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

FIG. 1 is a schematic structural diagram of a driving power control apparatus for a vehicle;

FIG. 2 is a block diagram showing the internal structures of a neuro computer and a throttle computer;

FIG. 3 is a diagram showing the conceptual structure of a multi-field neural network adapted in the neuro computer;

FIG. 4 is a flowchart illustrating a "requested acceleration predicting and throttle sensitivity computing routine" that is executed by the neuro computer;

FIG. 5 is a flowchart illustrating the "requested acceleration predicting and throttle sensitivity computing routine" that is executed by the neuro computer;

FIG. 6 is a flowchart illustrating a "throttle angle control routine" that is executed by the throttle computer; and FIG. 7 is a graph showing various patterns of the acceleration stroke v.s. time.

FIGS. 8 through 11 illustrate a driving power control apparatus for a vehicle according to a second embodiment of the present invention.

FIG. 8 is a diagram showing the conceptual structure of a competitive learning neural network adapted in the neuro computer;

FIG. 10 is a flowchart illustrating a part of a "requested acceleration predicting and throttle sensitivity computing routine" that is executed by the neuro computer; and FIG. 11 is a graph showing various patterns of the acceleration stroke v.s. time.

DETAILED DESCRIPTION OF THE PREFERRED EMBODIMENTS

First and second embodiments of the present invention will be described. The basic mechanical and electrical structures of the driving power control apparatus embodying the present invention will be discussed in the section of the first embodiment. The section of the second embodiment will mainly discuss the differences between the second embodiment and the first embodiment.

First Embodiment

The first embodiment of this invention will now be described with reference to FIGS. 1 through 7.

Figure 1:
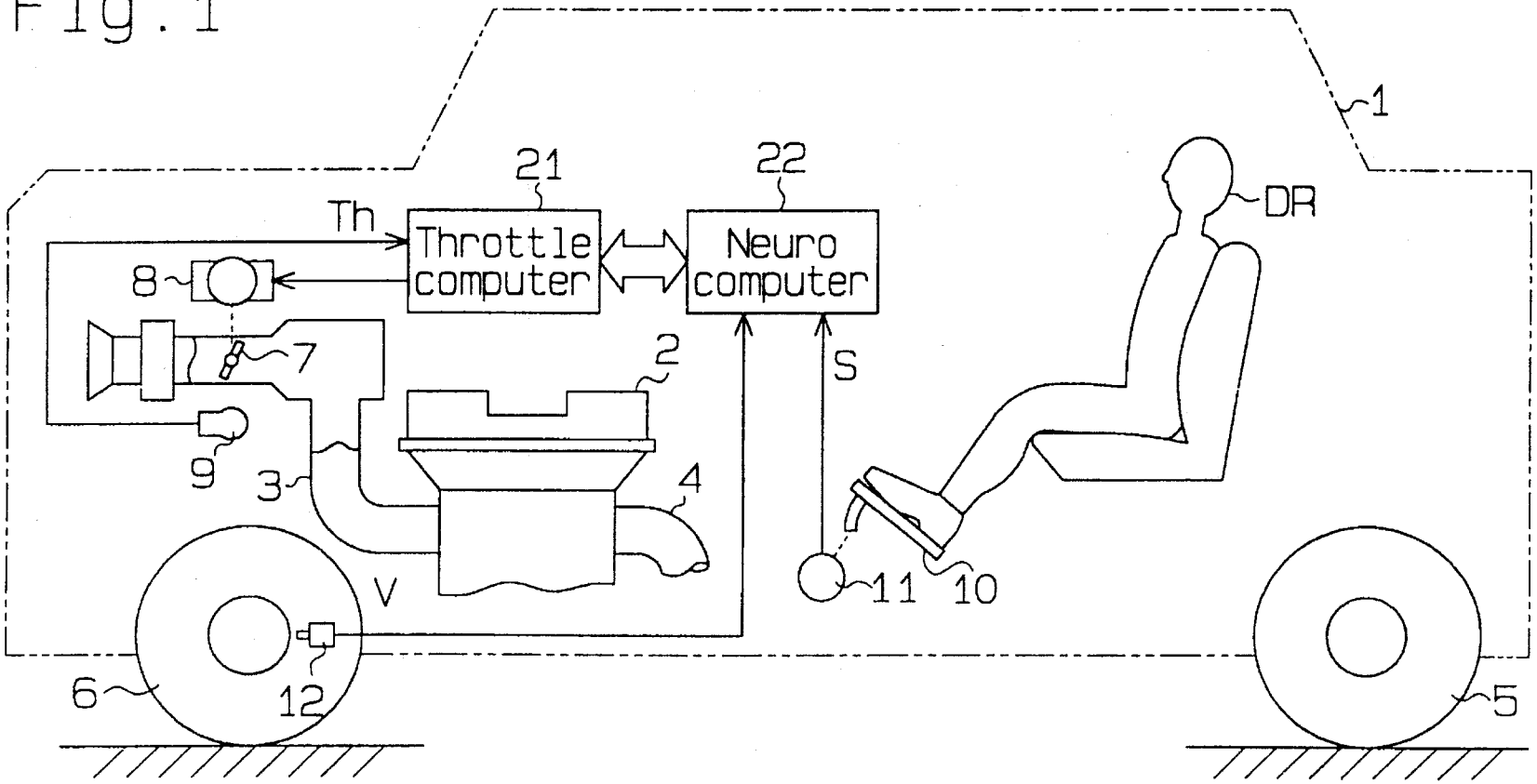
FIGS. 1 through 7 illustrate a driving power control apparatus for a vehicle according to a first embodiment of the present invention.

As shown in FIG. 1, a gasoline engine (hereinafter simply called "engine") 2 is mounted at the front portion of a vehicle 1. The engine 2 has a plurality of in-line cylinders. A fuel mixture consisting of air and fuel is fed via an air intake passage 3 in a combustion chamber provided for each cylinder in the engine 2. As this fuel mixture is ignited and burnt by an ignition plug, the piston, crankshaft, etc. are moved to provide the output of the engine 2. The gas generated by the combustion moves out of the cylinder through an exhaust passage 4.

The crankshaft of the engine 2 is coupled to a pair of rear wheels 5 as driving wheels, through a transmission, a propeller shaft, a differential gear, a drive shaft, etc. A pair of front wheels 6, which are driven wheels, are interlocked with the manipulation of a steering wheel provided at the driver's seat.

A throttle valve 7 is supported pivotable in a throttle body at the middle portion of the air intake passage 3 by a pivot 7*a*. This pivot 7*a* is coupled to a DC motor 8 provided in the vicinity of the throttle valve 7. As the DC motor 8 is driven, the throttle valve 7 rotates together with the pivot 7*a*. Through this rotation, the angle of the throttle valve 7 (throttle angle Th) is adjusted. This angle adjustment adjusts the amount of air that is taken into each combustion chamber of the engine, controlling the output of the engine 2.

Provided in the proximity of the throttle valve 7 is a throttle sensor 9 for detecting the throttle angle Th. An accelerator pedal 10 is provided at the driver's seat in the vehicle 1. This accelerator pedal 10 is manipulated by a driver DR to control the output of the engine 2. Provided in the vicinity of the accelerator pedal 10 is an accelerator pedal sensor 11 for detecting the acceleration stroke S or the amount of the manipulation. The front wheel 6 is provided with a vehicle speed sensor 12 for detecting the vehicle speed V of the vehicle 1 in accordance with the number of rotations of the front wheels 6.

A throttle computer 21 and a neuro computer 22 are used to properly control the opening/closing of the throttle valve 7 in response to the request made by the driver DR. The computer 21 is connected to the DC motor 8 and the throttle sensor 9. The computer 22 is constituted using the neural network technology. Connected to the computer 22 are the accelerator pedal sensor 11 and the vehicle speed sensor 12. Both computers 21 and 22 are mutually connected.

Figure 2:
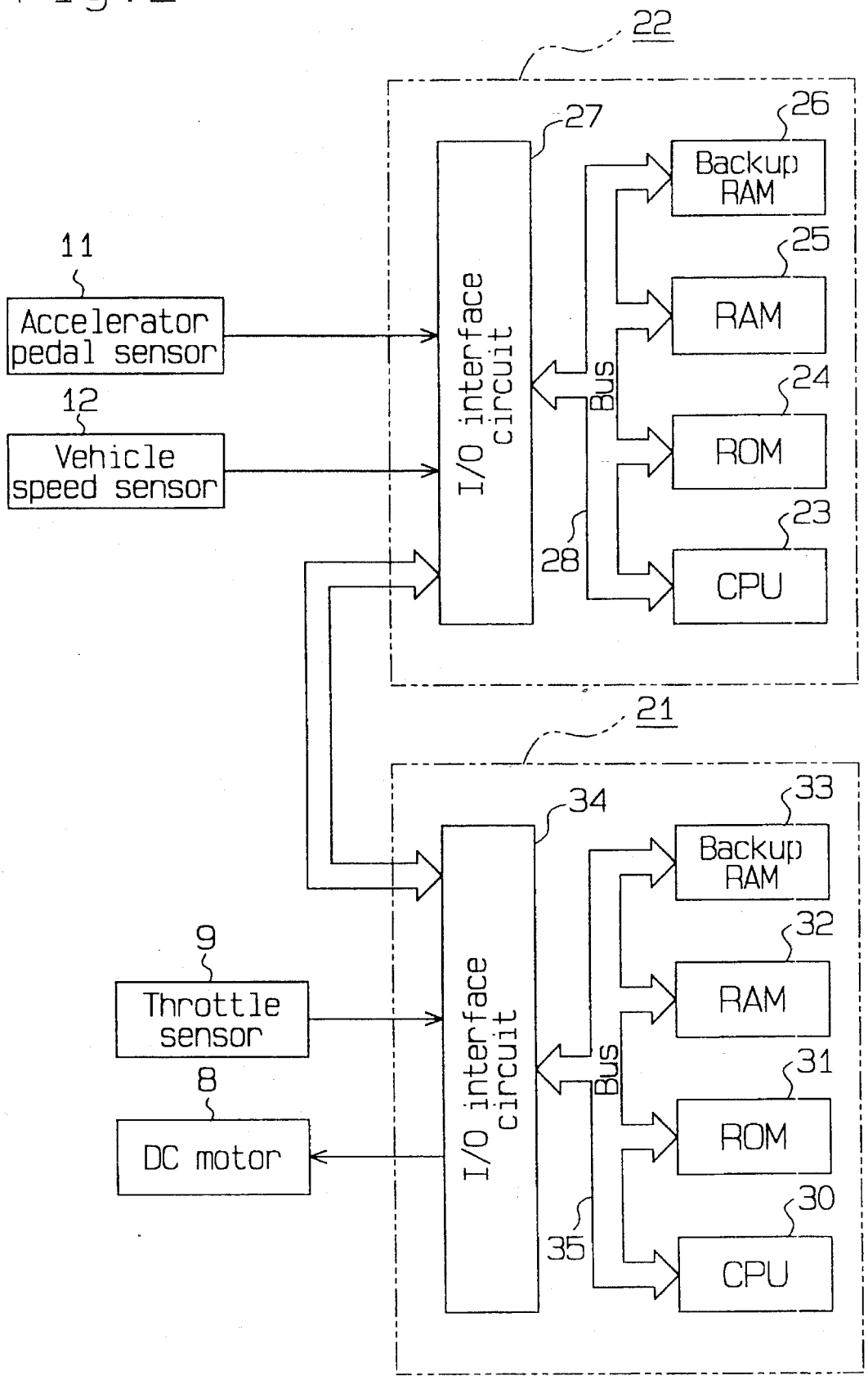

As shown in FIG. 2, the computer 22 includes a central processing unit (CPU) 23, a read only memory (ROM) 24, a random access memory (RAM) 25, a backup RAM 26 and an input/output (I/O) interface circuit 27. Those units are mutually connected by a bus 28. The ROM 24 holds in advance a learning control program based on the neural network technology and initial data. The CPU 23 executes various kinds of operations in accordance with the learning control program and initial data. The CPU 23 also has a counter function. The RAM 25 temporarily stores the results of the operations executed by the CPU 23. The backup RAM 26 is backed up by a battery to hold various types of data in the RAM 25 even after power supply to the computer 22 is stopped.

The accelerator pedal sensor 11 and the vehicle speed sensor 12 are connected to the I/O interface circuit 27. The computer 21 is connected to the I/O interface circuit 27.

The CPU 23 receives various signals from the individual sensors 11 and 12 via the I/O interface circuit 27. Based on the input signals, the CPU 23 predicts the "requested acceleration" requested by the driver DR in accordance with the aforementioned learning control program. The CPU 23 also executes control of the computation of a throttle sensitivity Thg which is the control amount sensitivity according to that prediction. The CPU 23 sends out the computation results to the throttle computer 21 via the I/O interface circuit 27.

The structure of the throttle computer 21 is basically the same as that of the computer 22. The computer 21 comprises a CPU 30, a ROM 31, a RAM 32, a backup RAM 33, an I/O interface circuit 34, and a bus 35. The DC motor 8, the throttle sensor 9 and the neuro computer 22 are connected to the I/O interface circuit 34. A throttle angle control program is stored in advance in the ROM 31. This program controls the opening/closing of the throttle valve 7 based on the learning result of the neuro computer 22 or values that are separately set.

The CPU 30 receives data of the learning results sent from the neuro computer 22 via the I/O interface circuit 34. The CPU 30 also receives a signal sent from the throttle sensor 9 via the I/O interface circuit 34. Based on those input signals, the CPU 30 properly controls the DC motor 8 in accordance with the aforementioned throttle angle control program.

The conceptual structure of the neural network technology adapted to the neuro computer 22 will be discussed below.

Figure 3:
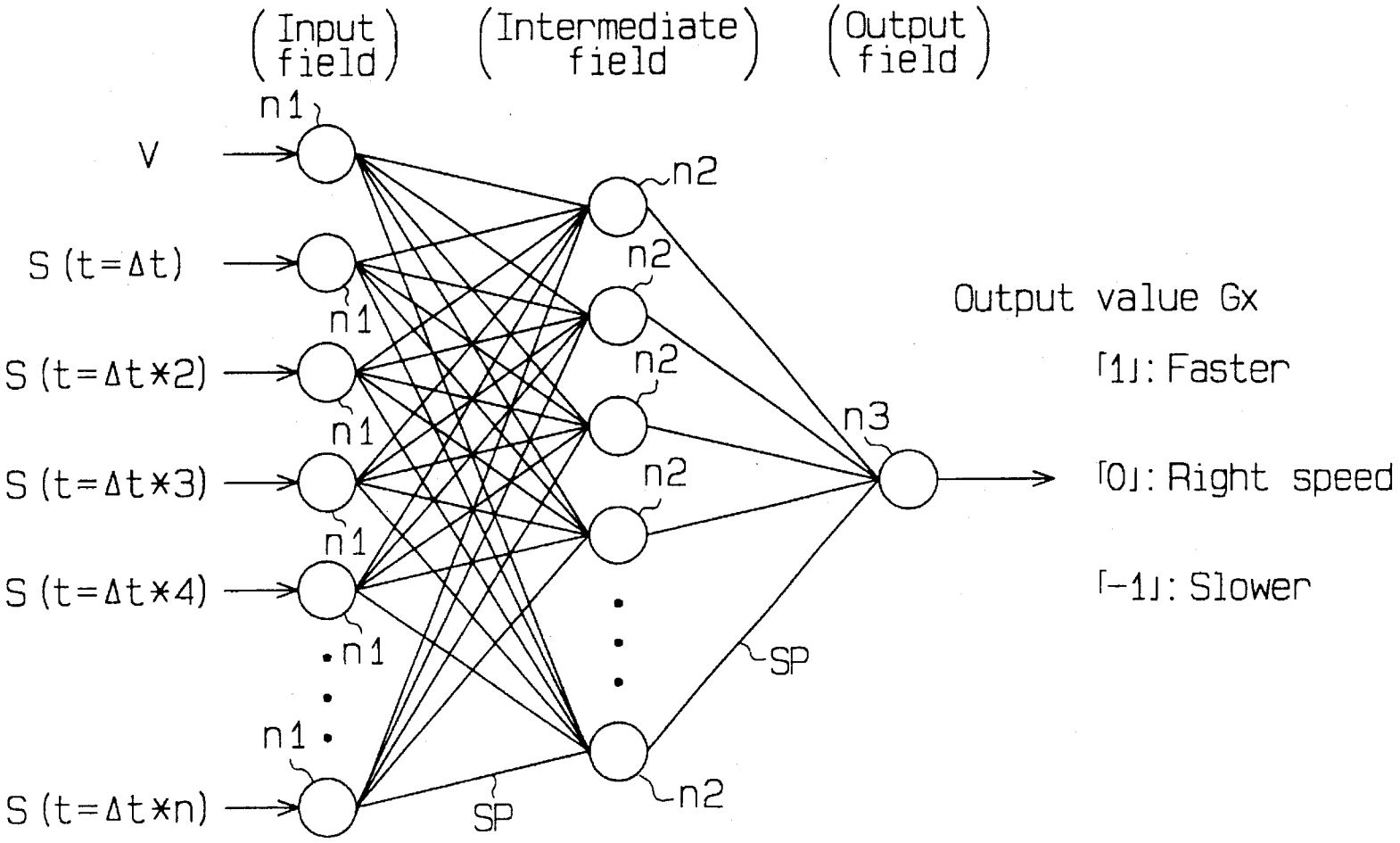

The network technology in the first embodiment employs a multi-field neural network as shown in FIG. 3. This multi-field neural network includes an "input field" having (N+1) neurons n1, an "intermediate field" having two to ten neurons n2, and an "output field" having a single neuron n3. The individual neurons n1, n2 and n3 in those fields are coupled together by synapses sp. In this multi-field neural network, signals flow in one direction from the "input field", to the "intermediate field" and to the "output field". The status of each of the neurons n1, n2 and n3 of the individual fields is determined on the basis of the signal received from the preceding field. Then, the signal will be sent to the next field. The output result of the multi-field neural network is obtained as the state value of the neuron 3 of the "output field".

In the above multi-field neural network, the vehicle speed V detected by the vehicle speed sensor 12 and the acceleration stroke S detected by the accelerator pedal sensor 11 are input to each neuron n1 of the "input field". The acceleration stroke S is what has been sampled every time Δt until a predetermined time T (e.g., two to seven seconds) elapses from the start of the vehicle 1, and constitutes a time series data. The sampling time Δt is the predetermined time T equally divided by N (N=50, for example). As the output value obtained from the neuron n3 of the "output field", one of three values "1" (faster), "0" (the right speed) and "−1" (slower) is selected based on the above input values.

The output value Gx differs depending on the "weighting factors" of the individual synapses sp. In this embodiment, however, the "weighting factors" have already been set before shipment of the vehicle 1, and becomes unchanged after the shipment. Before the delivery of the vehicle 1, many experiments are repeated and the "weighting factors" are corrected based on the data obtained from the experiments and the evaluation values of the driving performance by drivers ("1" (faster), "0" (the right speed) and "−1" (slower)). The "weighting factors" are designed to be suitable for users in the destination of the shipment (e.g., the destination country). A typical "error feedback learning algorithm" is applied to this correction. After the shipment of the vehicle 1, therefore, as the vehicle speed V and the time series data of the acceleration stroke S are input, the output value Gx of any one of the three levels is output as a "requested acceleration predicting model" based on the previously set "weighting factors" of the individual synapses sp.

The neural network is realized by mathematical operations in the prediction control program. In this embodiment, the prediction control program has been prepared to finally obtain a throttle sensitivity Thg which will be described later.

Figure 4:
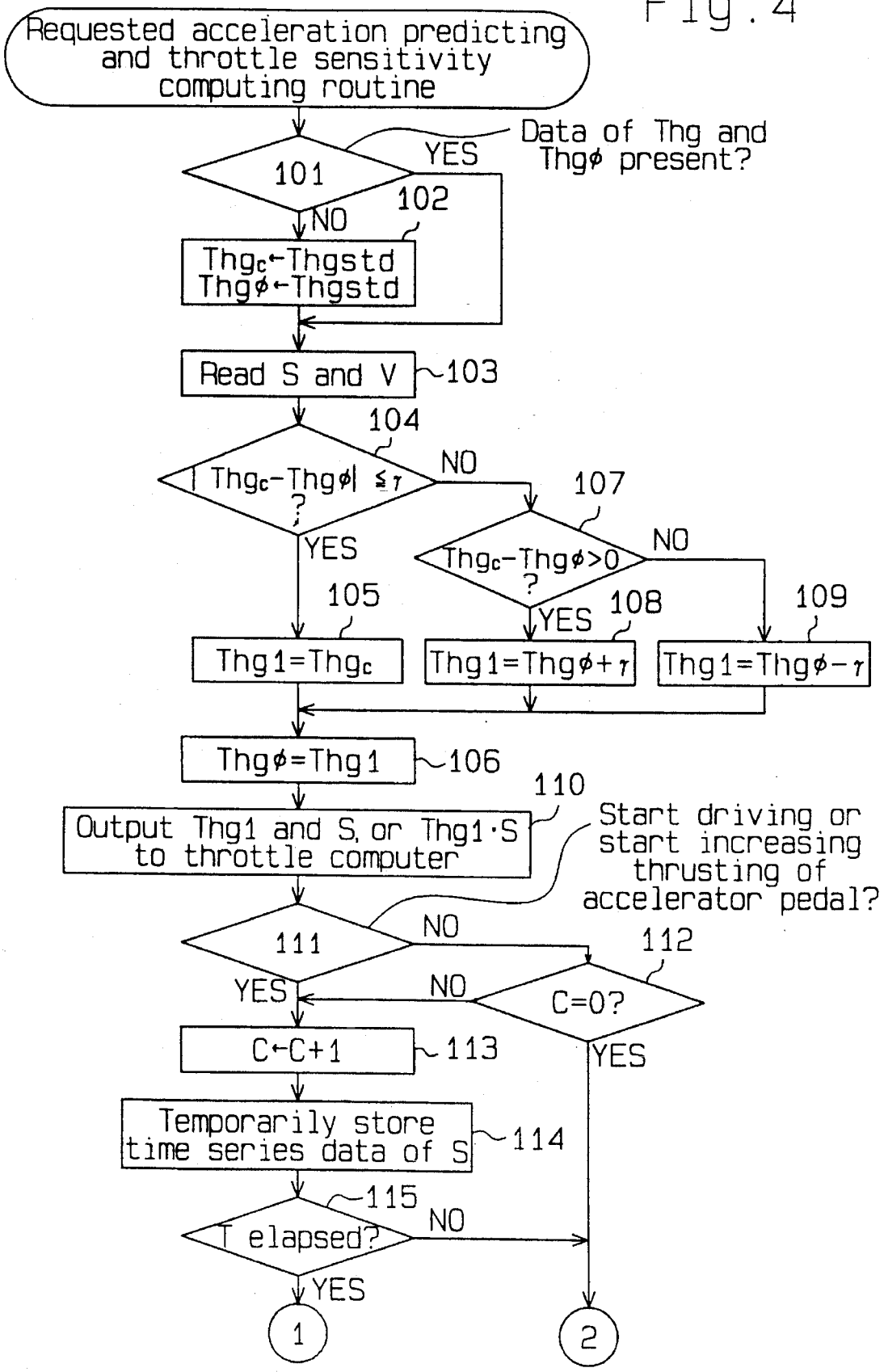
Figure 5:
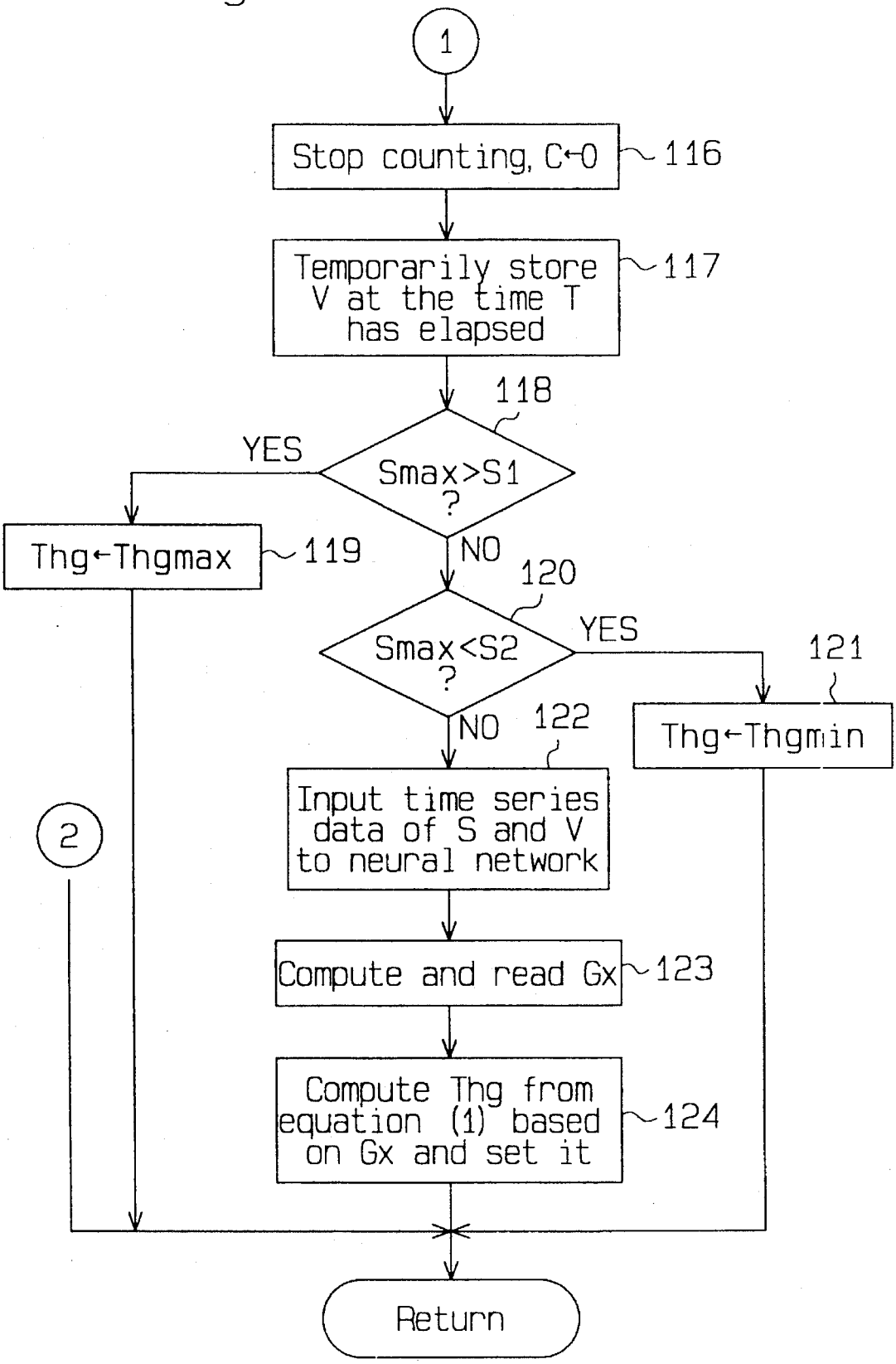

A description will now be given of operations for predicting the requested acceleration and for computing the throttle sensitivity, which are executed by the computer 22 using the above-described neural network technology. FIGS. 4 and 5 present a flowchart illustrating the "requested acceleration predicting and throttle sensitivity computing routine" in the prediction control program and computing program that are executed by the computer 22. The processes of this routine will be performed every given cycle at an interval of, for example, "0.1 sec" after the routine starts.

When this routine starts, the CPU 23 determines whether or not data of the throttle sensitivity $Thg_c$ and data of the previously output throttle sensitivity Thg0 are currently present in the RAM 25 (step 101). If the data of the throttle sensitivities Thg and Thg0 are not present in the RAM 25, the CPU 23 sets a predetermined reference value Thgstd (e.g., Thgstd=1.0) as the current throttle sensitivity Thg and the previously output throttle sensitivity Thg0 (step 102) and the program proceeds to the next step 103.

If the data of the throttle sensitivities Thg and Thg0 are already present in the RAM 25, on the other hand, the CPU 23 goes to step 103.

Then, the CPU 23 reads the acceleration stroke S and the vehicle speed V based on the signals from the accelerator pedal sensor 11 and the vehicle speed sensor 12 (step 103).

Next, the CPU 23 compares the currently set throttle sensitivity $Thg_c$ with the previously output throttle sensitivity Thg0 to prevent the throttle sensitivity Thg from drastically changing (step 104). If the absolute value of the difference between the current throttle sensitivity Thg and the previous throttle sensitivity Thg0 is equal to or smaller than a predetermined sensitivity change γ ("0.1" in this embodiment), the CPU 23 proceeds to step 105. In this step 105, the CPU 23 sets a throttle sensitivity Thg1, which will be output this time, to the throttle sensitivity Thg.

Subsequently, the CPU 23 stores the throttle sensitivity Thg1, which will be output this time, as the previous throttle sensitivity Thg0 in the RAM 25 (step 106).

If the absolute value of the difference between the current throttle sensitivity $Thg_c$ and the previous throttle sensitivity Thg0 is greater than the predetermined sensitivity change γ in step 104, the CPU 23 proceeds to step 107. In this step 107, the CPU 23 determines if the difference between the current throttle sensitivity $Thg_c$ and the previous throttle sensitivity Thg0 is positive or negative. If that difference is positive, the CPU 23 sets the throttle sensitivity Thg1, which will be output this time, as the previous throttle sensitivity Thg0 plus the sensitivity change γ (step 108), and then jumps to step 106. If the difference is negative or zero, on the other hand, the CPU 23 sets the throttle sensitivity Thg1, which will be output this time, as the previous throttle sensitivity Thg0 minus the sensitivity change γ (step 109), and then jumps to step 106.

After executing the step 106, the CPU 23 outputs the throttle sensitivity Thg1, which will be output this time, and the acceleration stroke S to the throttle computer 21 (step 110). Alternatively, the CPU 23 obtains the product of the throttle sensitivity Thg1 and the acceleration stroke S (target throttle angle Thg1·S) and outputs the target throttle angle Thg1·S to the throttle computer 21.

Next, based on the acceleration stroke S and vehicle speed V read in the routine this time, the CPU 23 determined whether or not the vehicle 1 has just started or the driver has just started increasing the thrust amount of the accelerator pedal (step 111). In this embodiment, the condition for determining the start of the vehicle 1 is that the ratio of an increase in acceleration stroke S in the current routine to the acceleration stroke S in the previous routine is equal to or above "3%" and the vehicle speed V is equal to or less than "5 km/h". The condition for determining that the driver has just started increasing the thrust amount of the accelerator pedal is that this ratio of an increase in acceleration stroke S is equal to or above "5%". If the current state of the vehicle is such that the vehicle 1 has just started or the driver has just started increasing the thrust amount of the accelerator pedal, the CPU 23 increments the count value C set in a timer by "1" (step 113).

If the current state of the vehicle 1 is otherwise, the program proceeds to step 112 where the CPU 23 determines if the count value C set in the timer incorporated in the CPU 23 is "0". If the count value C is "0", the CPU 23 judges that the condition for changing and setting the throttle sensitivity Thg is not satisfied, and temporarily terminates the subsequent process.

If the count value c is not "0", on the other hand, the CPU 23 judges that the condition for changing and setting the throttle sensitivity Thg is satisfied and the measuring of the time by the timer is currently in progress. Then, the CPU 23 increments the counter value C in the timer by "1" in the aforementioned step 113.

Next, the CPU 23 temporarily stores the time series data of the acceleration stroke S in the RAM 25 (step 114).

The CPU 23 then determines if the time based on the count value C is greater than the predetermined time T, i.e., if the predetermined time T has elapsed since the start of the vehicle 1 or the start of the driver's further stepping on the accelerator pedal (step 115). When the predetermined time T has not passed yet, the CPU 23 temporarily terminates the subsequent process. Thus, the CPU 23 repeats the operation for temporarily storing the time series data of the acceleration stroke S in the RAM 25 until the predetermined time T elapses.

When the predetermined time T has elapsed since the start of the vehicle 1 or the start of the driver's further stepping on the accelerator pedal, the CPU 23 stops the timer to perform the counting and resets the count value C (step 116).

Further, the CPU 23 stores the vehicle speed V at the point of time where the predetermined time T has elapsed since the start of the vehicle 1 or the start of the driver's further stepping on the accelerator pedal, in the RAM 25 temporarily (step 117).

In the next step 118, the CPU 23 determines whether or not the maximum value (maximum acceleration stroke Smax) among the time series data of the acceleration stroke S temporarily stored in the RAM 25 in the current routine is greater than a first predetermined value S1 (for example, "80%" of the allowable maximum stroke in this embodiment). If the maximum acceleration stroke Smax is greater than the first predetermined value S1, the CPU 23 judges that the acceleration requested by the driver DR is very large, and moves to step 119. In this step 119, the CPU 23 sets the throttle sensitivity Thg to the maximum throttle sensitivity Thgmax (for example, "1.5" in this embodiment) before temporarily terminating the subsequent process.

If the maximum acceleration stroke Smax is not greater than the first predetermined value S1, the CPU 23 proceeds to step 120. In this step 120, the CPU 23 determines whether or not the maximum acceleration stroke Smax is smaller than a second predetermined value S2 (for example, "10%" of the allowable maximum stroke in this embodiment). If the maximum acceleration stroke Smax is smaller than the second predetermined value S2, the CPU 23 judges that the acceleration requested by the driver DR is very small, and moves to step 121. The CPU 23 sets the throttle sensitivity Thg to the minimum throttle sensitivity Thgmin (for example, "0.5" in this embodiment) in this step 121, and then temporarily terminates the subsequent process.

If the maximum acceleration stroke Smax during the period from the start of the vehicle 1 to the point of the passing of the predetermined time T is greater than the first predetermined value S1, it is judged that the acceleration requested by the driver DR is very large. Then, the throttle sensitivity Thg is set to the maximum throttle sensitivity Thgmax without any condition. If this maximum acceleration stroke Smax is smaller than the second predetermined value S2, it is judged that the acceleration requested by the driver DR is very small. Then, the throttle sensitivity Thg is set to the minimum throttle sensitivity Thgmin without any conditions.

If the maximum acceleration stroke Smax is not smaller than the second predetermined value S2 in the aforementioned step 120, the CPU 23 judges it necessary to predict the requested acceleration more precisely, and proceeds to step 122.

Subsequently, the CPU 23 computes and reads the output value Gx to be output from the "output field" based on the input given to the "input field" (step 123). In this step, the output value Gx is set to "1", "0" or "−1" in accordance with the "weighting factors" of the individual synapses sp previously set before the shipment of the vehicle 1. And the acceleration requested by the driver DR is predicted as one numeral, the output value Gx, by the neural network.

Then, the CPU 23 computes the throttle sensitivity Thg from the following equation (1) based on the output value Gx computed in the current routine, and sets this value as a new throttle sensitivity Thg (step 124).

$$Thg=(\text{current})Thg+Gx*k1 \quad \text{(i)}$$

where k1 is a positive constant and is "0.1" for example.

Suppose that the current throttle sensitivity Thg is "1.0". When the output value Gx of the neural network is "1", it is predicted that the driver wants to drive faster than the current speed. In this case, the new throttle sensitivity Thg is set to "1.0+1×0.1=1.1" from the equation (1). When the output value Gx is "0", it is assumed that the driver wants to keep the current driving state. In this case, the new throttle sensitivity Thg is set to "1.0+0×0.1=1.0" from the equation (1), i.e., the current throttle sensitivity Thg is maintained. When the output value Gx is "−1", it is assumed that the driver wants to drive slower than the current speed. In this case, the new throttle sensitivity Thg is set to "1.0+(−1)×0.1=0.9" from the equation (1).

The prediction and computation controls using the neural network technology are carried out in the above manner, and the acceleration requested by the driver DR will be predicted, and the throttle sensitivity Thg will be computed and set.

Figure 6:
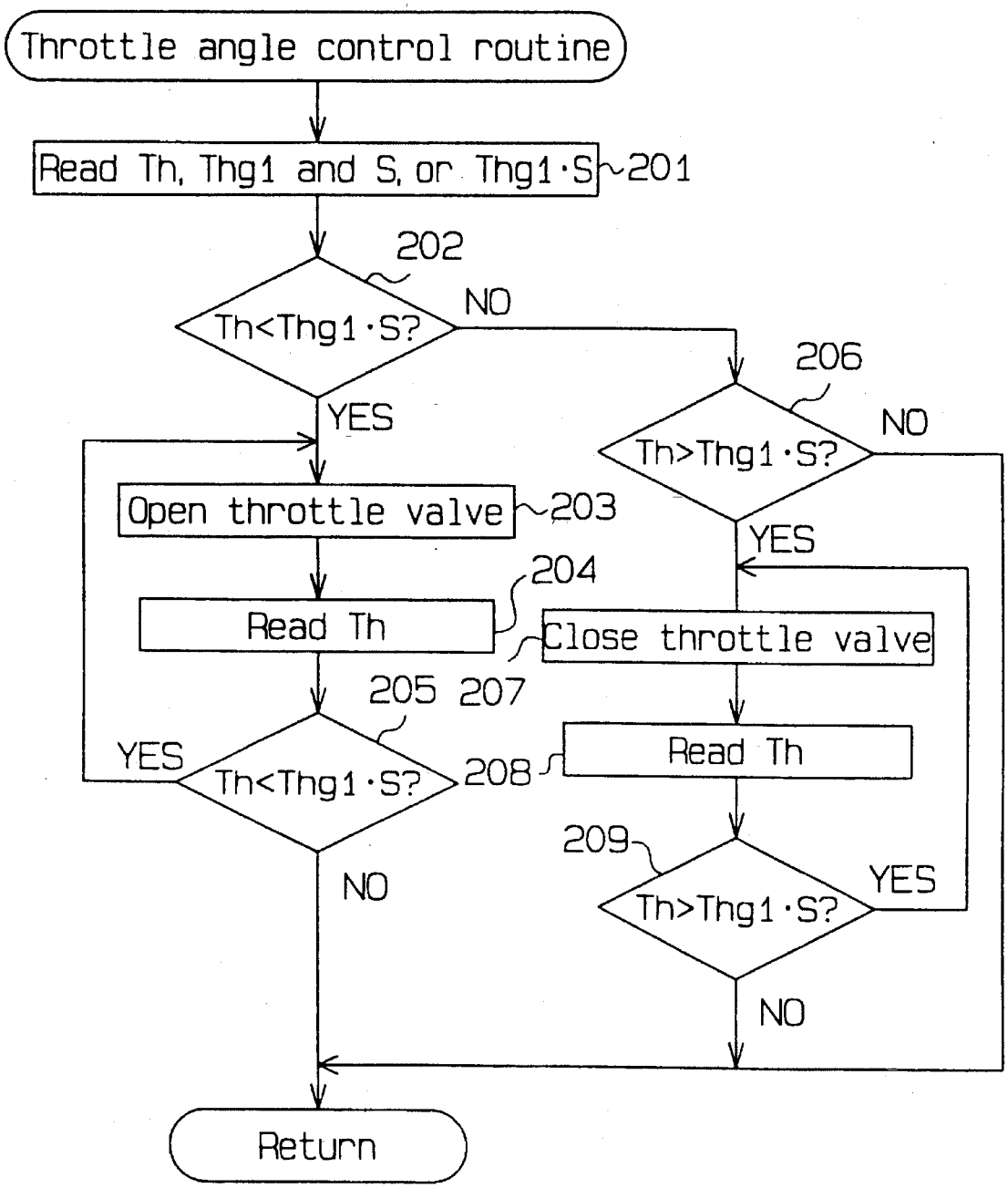

A description will now be given of the operations for the throttle angle control that is executed by the throttle computer 21, based on the throttle sensitivity Thg1 determined in the above-described "requested acceleration predicting and throttle sensitivity computing routine" and the acceleration stroke S given then. FIG. 6 shows a flowchart illustrating the "throttle angle control routine" in the throttle angle control program, which is run by the throttle computer 21. This routine will be executed cyclically at a given interval.

When this routine starts, the CPU 30 of the throttle computer 21 reads the current throttle angle Th from the RAM 32 based on the signal from the throttle sensor 9 in step 201. The computer 21 also reads the latest throttle sensitivity Thg and acceleration stroke S, output from the neuro computer 22, or the target throttle angle Thg·S (step 201). In the case where the CPU 30 reads the throttle sensitivity Thg and acceleration stroke S, the CPU 30 obtains the product of those two values as the target throttle angle Thg1·S in the step 201.

Then, the CPU 30 determines whether or not the current throttle angle Th is smaller than the target throttle angle Thg1·S (step 202). If the current throttle angle Th is smaller than the target throttle angle Thg1·S, the CPU 30 rotates the DC motor 8 forward to drive the throttle valve 7 in the opening direction (step 203). Subsequently, the CPU 30 reads the throttle angle Th again based on the signal from the throttle sensor 9 (step 204).

Then, the CPU 30 determines again whether or not the throttle angle Th is smaller than the target throttle angle Thg1·S (step 205). If the throttle angle Th is smaller than the target throttle angle Thg1·S, the CPU 30 proceeds to step 203 and will repeat the sequence of processes of steps 203, 204 and 205 to drive the throttle valve 7 further in the opening direction. If the throttle angle Th is equal to or greater than the target throttle angle Thg1·S, on the other hand, the CPU 30 temporarily terminates the subsequent processing so that the throttle valve 7 will not be driven in the opening direction any more.

If the throttle angle Th is not smaller than the target throttle angle Thg1·S in the step 202, the CPU 30 proceeds to step 206 to determine if the current throttle angle Th is greater than the target throttle angle Thg1·S. If the throttle angle Th is not greater than the target throttle angle Thg1·S, the CPU 30 temporarily terminates the subsequent processing.

If the throttle angle Th is greater than the target throttle angle Thg1·S, the CPU 30 rotates the DC motor 8 in the reverse direction to drive the throttle valve in the closing direction (step 207). The CPU 30 also reads the current throttle angle Th based on the signal from the throttle sensor 9 (step 208).

Then, the CPU 30 determines again whether or not the throttle angle Th is greater than the target throttle angle Thg1·S (step 209). If the throttle angle Th is greater than the target throttle angle Thg1·S, the CPU 30 proceeds to step 207 and will repeat the sequence of processes of steps 207, 208 and 209 to drive the throttle valve 7 further in the closing direction. If the throttle angle Th is equal to or smaller than the target throttle angle Thg1·S, on the other hand, the CPU 30 temporarily terminates the subsequent processing so that the throttle valve 7 will not be driven in the closing direction any more.

In this manner, the rotation of the DC motor 8 is controlled in such a way that the throttle angle Th matches with the target throttle angle Thg1·S, thus controlling the opening/closing of the throttle valve 7. Accordingly, the output of the engine 2 is controlled, and the driving power of the vehicle 1 is controlled as a consequence.

As described above, according to the first embodiment, at the time of performing computation to set the throttle sensitivity Thg, a request on the running of the vehicle 1 made by the driver DR is estimated as the "requested-acceleration model" from the occasional vehicle speed V and the time series data of the acceleration stroke S, using the "requested acceleration predicting model". Based on the estimated "requested acceleration", the throttle sensitivity Thg is set. Further, the target throttle angle Thg1·S is obtained by the product of the throttle sensitivity Thg1, computed from that throttle sensitivity Thg, and the acceleration stroke S, and the opening/closing of the throttle valve 7 is controlled in such a way that the target throttle angle Thg1·S coincides with the throttle angle Th. What is more, the "requested acceleration" according to a request made by the driver DR is always obtained. The throttle sensitivity Thg1 is obtained in association with that "requested acceleration". The throttle angle Th of the engine 2 is therefore always controlled with the acceleration that matches with the acceleration requested by the driver DR.

Figure 7:
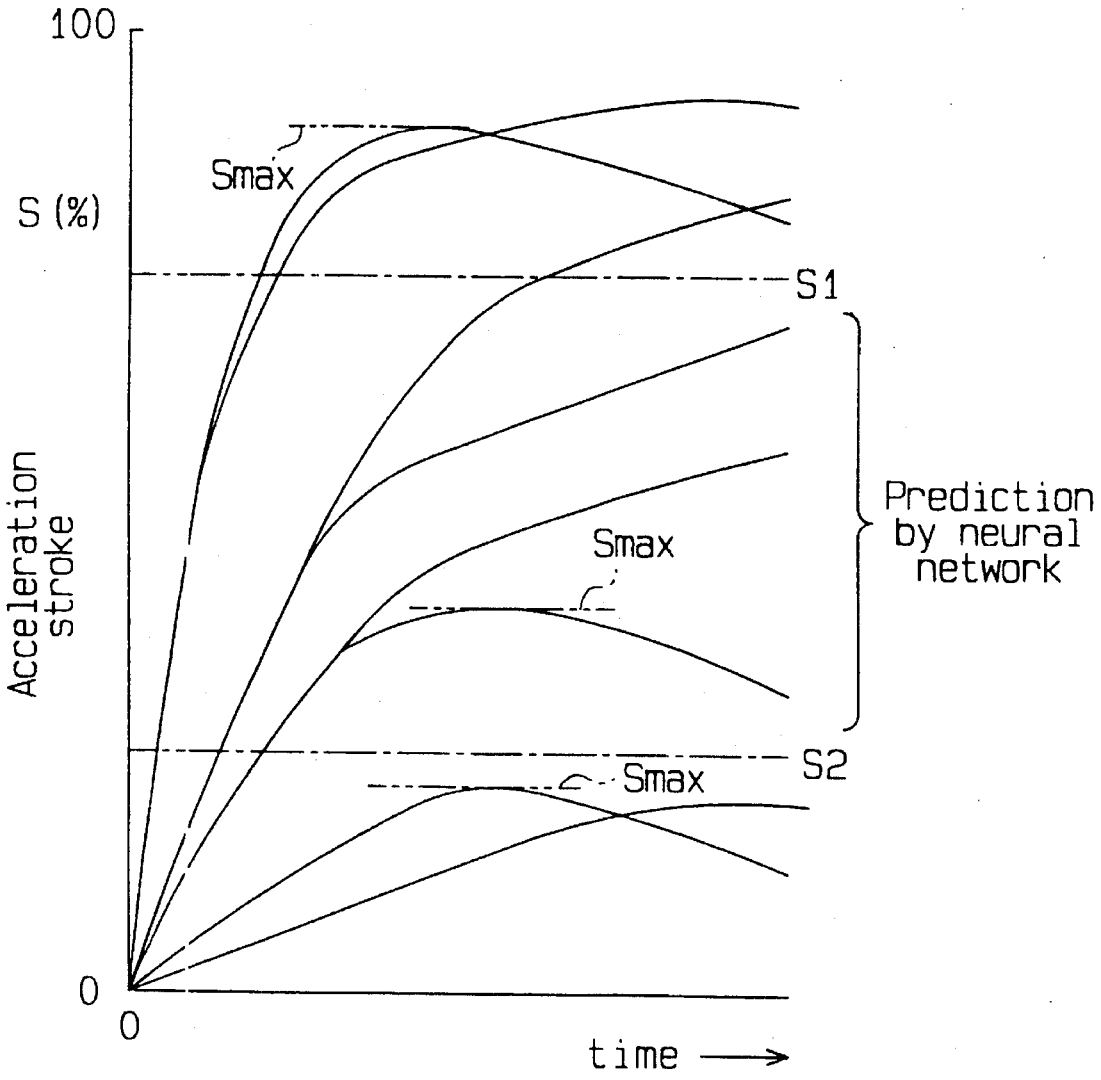

More specifically, if the maximum acceleration stroke Smax among the time series data of the acceleration stroke S shown in FIG. 7 is greater than the first predetermined value S1, it is judged that the acceleration requested by the driver DR is very large. In this case, the throttle sensitivity Thg is set to the maximum throttle sensitivity Thgmax. As a result, the range of a change in acceleration stroke S to obtain the same acceleration becomes narrower. A large acceleration will therefore be obtained by a small amount of thrusting on the accelerator pedal 10. As a result, the driver DR will feel as if the accelerating performance of the vehicle 1 has been improved. For example, when the driver DR is in a hurry or is driving the vehicle 1 on a clear expressway without a traffic jam and thus wants to drive the vehicle 1 faster, a large acceleration can be provided by a little thrusting on the accelerator pedal 10, thus improving the feeling of acceleration.

If the maximum acceleration stroke Smax shown in FIG. 7 is smaller than the second predetermined value S2, it is judged that the acceleration requested by the driver DR is very small. In this case, the throttle sensitivity Thg is set to the minimum throttle sensitivity Thgmin. This widens the range of a change in acceleration stroke S to obtain the same acceleration. Thus, the acceleration can be precisely changed by increasing the manipulation range of the accelerator pedal 10. As a result, the operability of the accelerator pedal 10 by the driver DR will be improved. For example, when the driver DR is not in a hurry or is driving the vehicle 1 on a road under poor conditions, such as during a traffic jam or snowy weather, it is reasonable that he may want to drive the vehicle 1 slowly. Accordingly, the acceleration can be precisely changed by increasing the manipulation range of the accelerator pedal 10, thus improving the operability of the vehicle 1.

If the maximum acceleration stroke Smax is equal to or greater than the second predetermined value S2 and is equal to or less than the first predetermined value S1 in the first embodiment, it is judged that the requested acceleration should be predicted more precisely. In this case, the requested acceleration will be predicted using the above-described neural network. More specifically, the vehicle speed V and the time series data of the acceleration stroke S are input, and the acceleration requested by the driver DR is predicted by the neural network using one variable, the output value Gx. What is requested by the driver DR, "faster driving", "keeping the current state" or "slower driving" is estimated from the output value Gx. The throttle sensitivity Thg is altered and set in accordance with that estimation.

Therefore, the throttle sensitivity Thg which matches with the characteristic of the driver DR is always determined. As a result, it is always possible to perform control on the driving power of the vehicle 1 which matches with the characteristic of the driver DR, regardless of the mental state of the driver DR (in a hurry, relaxed, etc.) and the driving environment (road conditions, day or night, inside a tunnel, rainy or snowy weather, mounting road, traffic jam, etc.).

In this embodiment, the neural network technology is used in the control of predicting the requested acceleration by the neuro computer 22. Further, since the neural network uses synapses sp, its sensitivity characteristic itself will not be partially discontinuous at the time of setting the throttle sensitivity Thg. With regard to the entire range of the vehicle speed V, therefore, it is possible to continuously control the driving power of the vehicle 1 over the entire range of the manipulation amount (acceleration stroke S) of the accelerator pedal 10 by the driver DR. When the driver DR continuously steps on the accelerator pedal, therefore, the acceleration of the vehicle 1 will not change abruptly and the vehicle speed V will always be increased smoothly.

Further, in this embodiment, no acceleration detecting means, such as an acceleration sensor, is used as means for predicting the requested acceleration. Instead, the data of the vehicle speed V and the time series data of the acceleration stroke S are used. The manufacturing cost of this apparatus will be reduced by the otherwise necessary cost for the acceleration detecting means.

Predicting the requested acceleration has been completed before the shipment of the vehicle 1 in this embodiment, so that no learning will be performed for that prediction during the actual driving. Therefore, the time required for the learning during driving is unnecessary and the cycle of controlling the opening/closing of the throttle valve 7 can be shortened by that time. This will prevent a delay in the control on the driving power of the vehicle 1 and will ensure faster power control.

Second Embodiment

The second embodiment of the present invention will be now described with reference to FIGS. 8 through 11. Those elements in the second embodiment which are basically the same in structure as the elements in the first embodiment will be given the same reference numerals to avoid repeating their description. The following description will be centered on the differences between the second embodiment and the first embodiment.

The second embodiment differs from the first embodiment in the contents of the neural network technology employed in the neuro computer 22.

The conceptual structure of the neural network employed in the computer 22 will be described below, with reference to FIG. 8.

Figure 8:
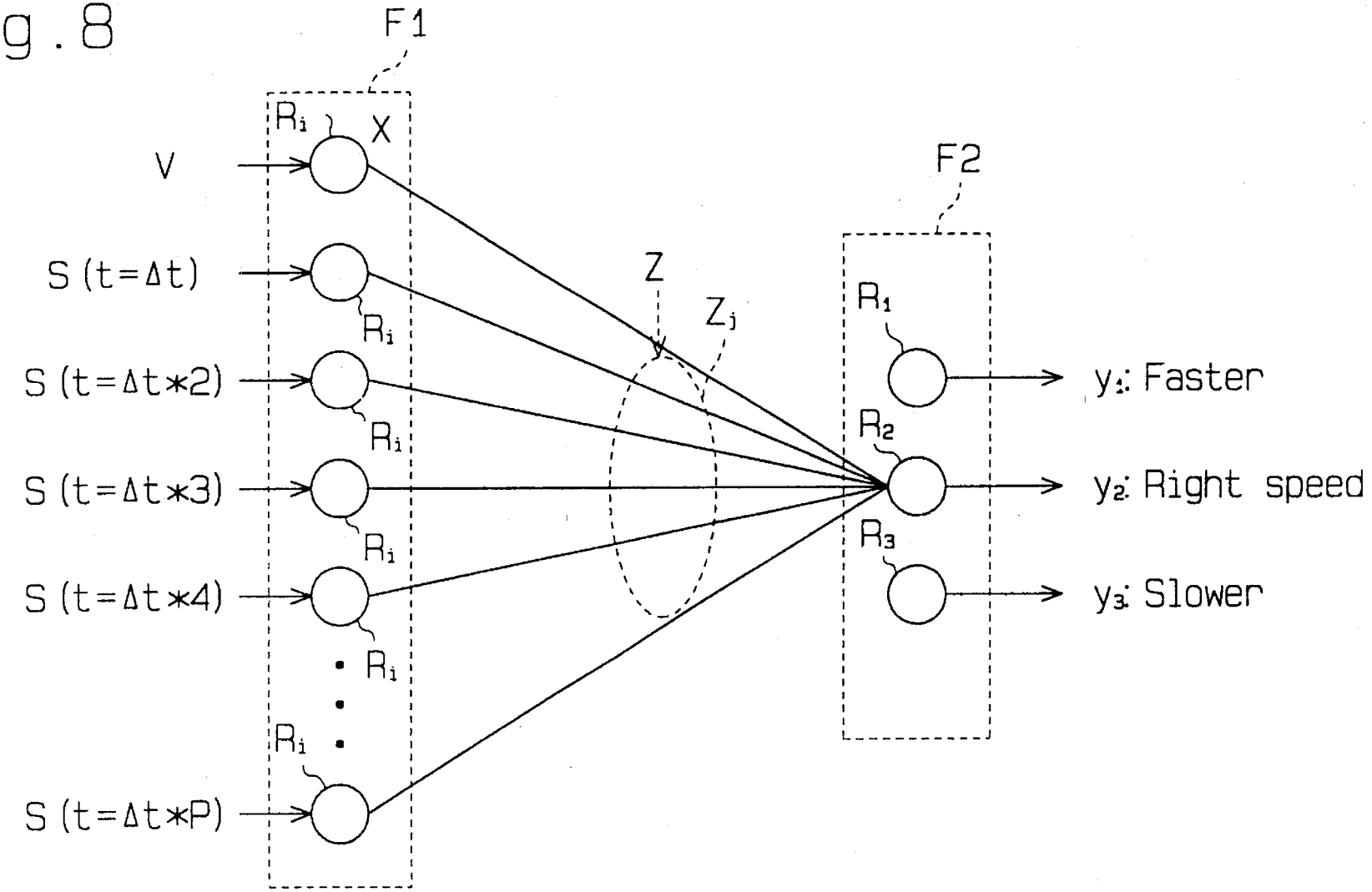

The neural network in this embodiment is an competitive learning neural network as shown in FIG. 8. To begin with, the concept of this competitive learning neural network will be explained. The competitive learning neural network has a field F1 expressing the feature of an input pattern (which is called "input field"), a field F2 expressing a category (which is called "output field"), and an adaptive filter Z provided with a theoretical load. When input patterns are given to the input field F1, exciting patterns $X=(x_1, x_2, \ldots, x_M)$ are generated in the input field F1. In accordance with the generation of the patterns, signals representing those patterns X are output from the individual elements of the input field F1. Those signals are transferred through the load of the adaptive filter Z to an element in the output field F2 and the sum of those signals is computed. Exciting patterns $Y=(y_1, y_2, \ldots, y_N)$ are generated in the output field F2.

In the below listed equation, $I_i$ (i=1, 2, . . . , M) is the input to the i-th element $R_i$ of the input field F1, $x_i$ is the degree of activity of the i-th element $R_i$, $y_j$ (j=1, 2, . . . , N) is the degree of activity of the j-th element $R_j$ of the output field F2, and $z_{ij}$ is the combined load from the i-th element $R_i$ of the input field F1 to the j-th element $R_j$ of the output field F2. The degree of activity (exciting pattern) appearing on each element of the input field F1 when input patterns are given to the input field F1 is given from the following equation (2). This equation (2) expresses the normalization of the input patterns.

$$X_i = I_i / \sum_{k=1}^{M} I_k \tag{2}$$

The sum $T_j$ of the signals the j-th element $R_j$ of the output field F2 receives from the input field F1 is expressed by the following equation (3).

$$T_j = \sum_{i=1}^{M} X_i \cdot Z_{ij} \tag{3}$$

The degree of activity $y_j$ of the j-th element $R_j$ of the output field F2 is given by the following equations (4) and (5), which indicate that the j-th element $R_j$ of the output field F2 that receives the maximum input wins the competition among the elements and its activity is selected as the exciting pattern Y of the output field F2.

$$y_j=1(\text{when } T_j=\max(T_k, k=, 2, \ldots, N)) \tag{4}$$

$$y_j=0(\text{when } T_j\neq\max(T_k, k=, 2, \ldots, N)) \tag{5}$$

The load vector $Z_j=(z_{1j}, z_{2j}, \ldots, z_M)$ of the selected j-th element $R_j$ is corrected (learned) through the following equation (6).

$$Z_{ij}=z_{ij}+\epsilon\cdot y_j\cdot(x_i-z_{ij}) \tag{6}$$

In the equation (6), $\epsilon$ ($0<\epsilon<1.0$) is the learning ratio of the load vector (adaptive filter).

It is apparent from this equation that the load vector $Z_j$ is corrected by the steepest decent method concerning the error between itself and the vector $x_1=(x_1, x_2, \ldots, x_M)$. The load vector $Z_j$ is therefore a map of the input pattern assigned to the element $R_j$.

The sampling time $\Delta t$ is a value obtained by dividing the predetermined time T by P (for example, P=50), and the number of input patterns, M, is M=1+P.

Figure 9A:
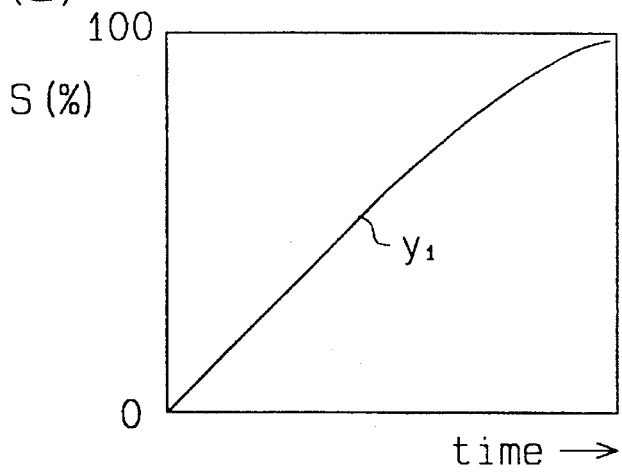
FIGS. 9A, 9B and 9C are diagrams showing acceleration patterns categorized by the competitive learning neural network.
Figure 9B:
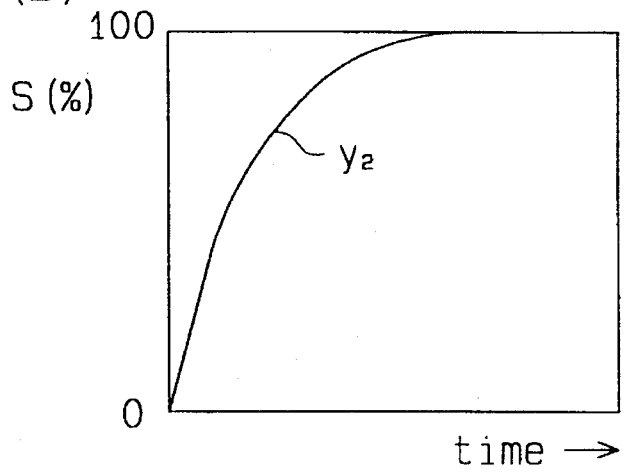
Figure 9C:
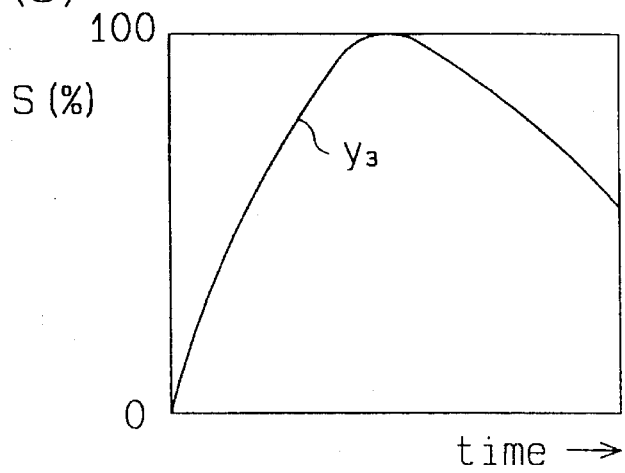
Figure 10:
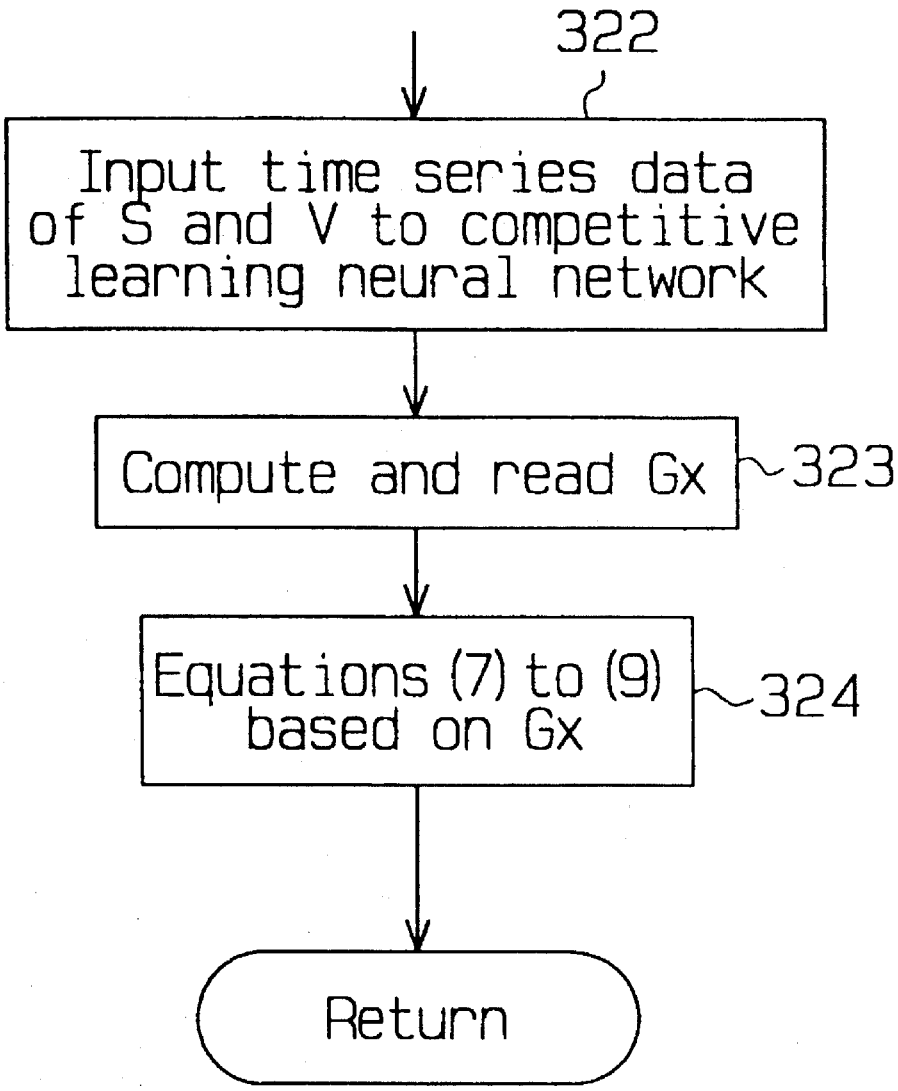

The elements $R_j$ of the output field F2 are categorized by the graphical representation of the relation of the acceleration stroke versus time. The elements $R_j$ consist of three elements $R_1$, $R_2$ and $R_3$. The acceleration patterns thus categorized are determined by the experiment data used in the learning and the evaluation of the driving performance of the driver (faster, the right speed, slower). Therefore, in the exciting pattern $y_1$ based on the element $R_1$, a pattern representing the driver's request to drive faster is graphically indicated as the relation of the acceleration stroke S versus the time, as shown in FIG. 9A. Likewise, in the exciting pattern $y_2$ based on the element $R_2$, a pattern representing the driver's request to keep the current speed is graphically indicated as the relation of the acceleration stroke S v.s. the time, as shown in FIG. 9B. In the exciting pattern $y_3$ based on the element $R_3$, a pattern representing the driver's request to drive slower is graphically indicated as the relation of the acceleration stroke S v.s. the time, as shown in FIG. 9C. The most excited value among the elements $R_j$ (j=1, 2, 3) of the output field F2 is selected and one of the exciting patterns $y_1$ to $y_3$ is output as the output pattern Gx. In FIG. 8, Z is the general term for the load vectors $Z_j$; only $Z_2$ is shown though.

The above selection would differ depending on the load vector $Z_j$ of the adaptive filter Z. In the second embodiment as in the first embodiment, however, the load vector $Z_j$ has already been set before the shipment of the vehicle 1 and becomes unchanged after the shipment. More specifically, in setting the load vector $Z_j$ of the adaptive filter Z, many experiments are repeated before the shipment of the vehicle 1 and the load vector $Z_j$ is corrected (learned) using the experiment data to be suitable for users in the destination of the shipment (e.g., the destination country).

After the shipment of the vehicle 1, one of the aforementioned three elements $R_1$, $R_2$ and $R_3$ is selected as an "acceleration pattern" from the vehicle speed V and the time series data of the acceleration stroke S, based on the previously set load vector $Z_j$. And, one output pattern Gx ($Gx=y_1$, $y_2$ or $y_3$) is output.

A description will now be given of the operations for predicting the requested acceleration and computing the throttle sensitivity Thg, which are executed using the above neural network. As the operations are almost the same as those of the "requested acceleration predicting and throttle sensitivity computing routine" that has already been discussed in the description of the first embodiment, only the differences between the second embodiment and the first embodiment will be described below.

In this embodiment, the processes of steps 101 to 121 in the first embodiment will be carried out in the same way as done in the first embodiment. Instead of steps 122 to 124 in the first embodiment, steps 322 to 324 shown in FIG. 10 will be executed.

After executing the processes up to step 120 as in the first embodiment, when the program proceeds to step 120, the CPU 23 inputs the vehicle speed V and the time series data of the acceleration stroke S, which have been temporarily stored, to the input field F1 of the above-described competitive learning neural network (step 322).

Subsequently, the CPU 23 computes the output pattern Gx to be output from the output field F2, based on the input given to the input field F1 and reads it in the RAM 25 (step 323). In this step, one of the exciting patterns $y_1$ to $y_3$ is set as the output pattern Gx by the load vector $Z_j$, which was set before the shipment of the vehicle 1.

Therefore, the acceleration requested by the driver DR is predicted from the output pattern Gx, by the competitive learning neural network.

Then, the CPU 23 computes the throttle sensitivity Thg from the following equations (7) to (9) based on the output pattern Gx read in the current routine, and sets this value as a new throttle sensitivity Thg (step 324).

$$Thg=(\text{current})Thg+\Delta Thg \text{ when } Gx=y_1 \quad (7)$$

$$Thg=(\text{current})Thg \text{ when } Gx=y_2 \quad (8)$$

$$Thg=(\text{current})Thg-\Delta Thg \text{ when } Gx=y_3 \quad (9)$$

where ΔThg is a positive constant which is "0.1" for example.

Suppose that the current throttle sensitivity Thg is "1.0". When the output pattern Gx of the neural network is "$y_1$", it is predicted that the driver DR wants to drive faster than the current speed. In this case, the new throttle sensitivity Thg is set to "1.0+0.1=1.1" from the equation (7). When the output pattern Gx is "$y_2$", it is assumed that the driver DR wants to keep the current driving state. In this case, the new throttle sensitivity Thg is set to "1.0" from the equation (8). When the output pattern Gx is "$y_3$", it is assumed that the driver DR wants to drive slower than the current speed. In this case, the new throttle sensitivity Thg is set to "1.0−0.1=0.9" from the equation (9).

The prediction and computation controls using the neural network technology are carried out in the above manner, and the acceleration requested by the driver DR will be predicted, and the throttle sensitivity Thg will be computed and set. The throttle computer 21 controls the throttle angle based on the throttle sensitivity Thg1, determined through the above-described processes, and the acceleration stroke S at that time. During this control, the operation of the throttle computer 21 is the same as that in the "throttle angle control routine" which has been explained in the foregoing description of the first embodiment. In short, the rotation of the DC motor 8 is controlled in such a way that the throttle angle Th matches with the target throttle angle Thg1·S, thus controlling the opening/closing of the throttle valve 7. Accordingly, the output of the engine 2 is controlled, and the driving power of the vehicle 1 is controlled as a consequence.

As described above, the second embodiment has nearly the same function and advantages as the first embodiment. More specifically, at the time of performing computation to set the throttle sensitivity Thg, a request (acceleration request) on the running of the vehicle 1 made by the driver DR is categorized by the neural network, etc. as the "acceleration pattern" from the occasional vehicle speed V and the time series data of the acceleration stroke S. Based on the categorization, the requested acceleration is estimated. Based on the estimated "requested acceleration", the throttle sensitivity Thg is set. The throttle sensitivity Thg1 is obtained from that throttle sensitivity Thg and the target throttle angle Thg1·S is obtained by the product of the throttle sensitivity Thg1 and the acceleration stroke S. The opening/closing of the throttle valve 7 is controlled in such a way that the target throttle angle Thg1·S coincides with the throttle angle Th. Therefore, the "requested acceleration" according to a request made by the driver DR is always obtained, and the throttle sensitivity Thg1 is obtained in association with that "requested acceleration". The throttle angle Th of the engine 2 is therefore always controlled based on the acceleration that is requested by the driver DR.

Figure 11:
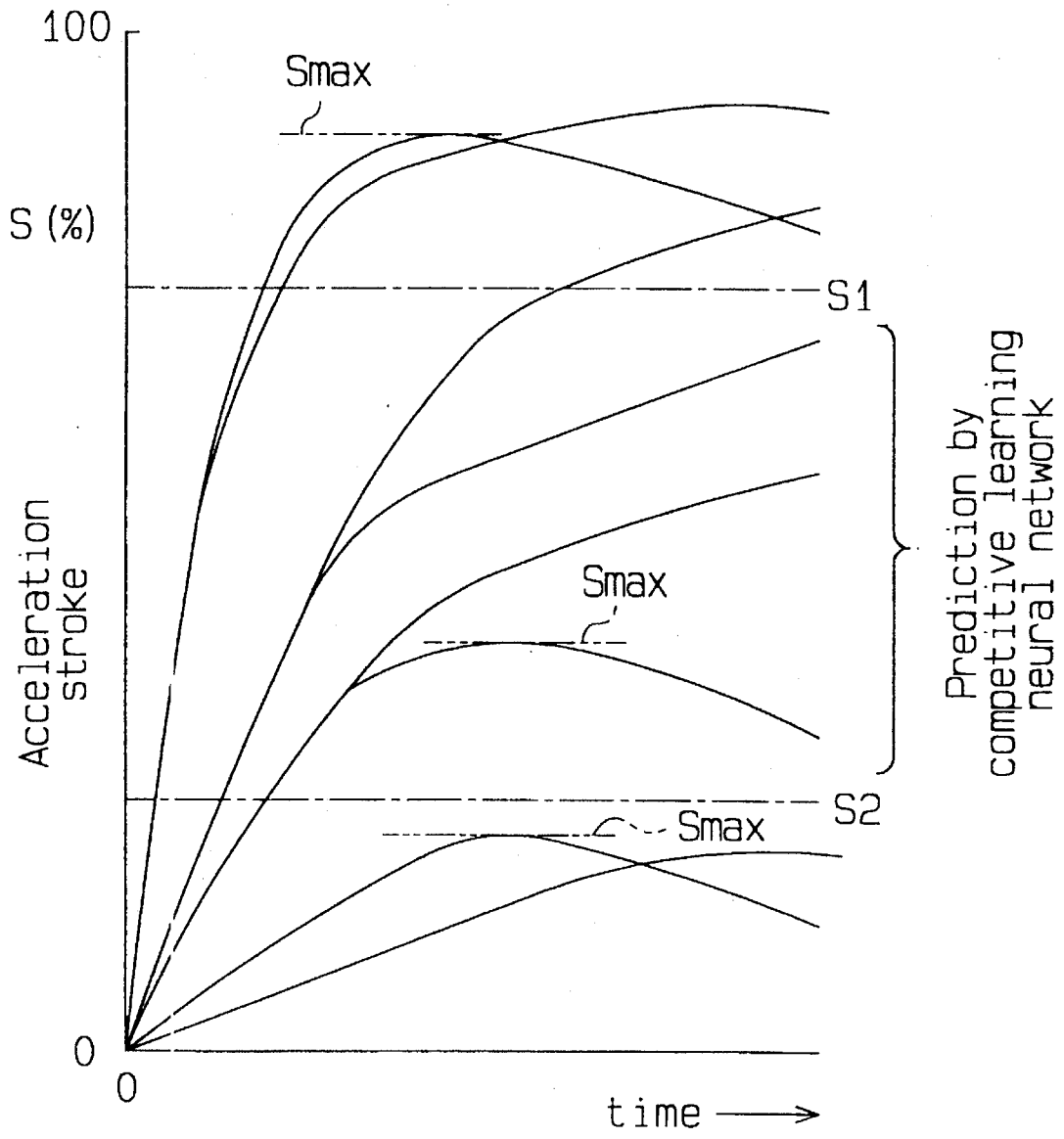

If the maximum acceleration stroke Smax among the time series data of the acceleration stroke S shown in FIG. 11 is greater than the first predetermined value S1, it is judged that the acceleration requested by the driver DR is very large. If the maximum acceleration stroke Smax shown in FIG. 11 is smaller than the second predetermined value S2, it is judged that the acceleration requested by the driver DR is very small. The second embodiment will therefore provide the same advantages as the first embodiment.

If the maximum acceleration stroke Smax is equal to or greater than the second predetermined value S2 and is equal to or less than the first predetermined value S1 in the first embodiment, it is judged that the requested acceleration should be predicted more precisely. Then, the requested acceleration will be predicted using the above-described competitive learning neural network.

In other words, the acceleration pattern is categorized as the graphical relation between the acceleration stroke and the time. What is requested by the driver DR, "faster driving", "keeping the current state" or "slower driving" is estimated as the requested acceleration from the output pattern Gx. The throttle sensitivity Thg is altered and set in accordance with that requested acceleration.

The second embodiment also takes the vehicle speed V and the time series data of the acceleration stroke S so that the actual acceleration matches with the degree of acceleration (requested acceleration) requested by the driver DR. Therefore, it is always possible to perform control on the driving power of the vehicle 1 which matches with the characteristic of the driver DR, regardless of the mental state of the driver DR and the driving environment as per the first embodiment.

In this embodiment, the competitive learning neural network technology is used in the control of predicting the requested acceleration by the computer 22. Further, the load vector $Z_j$ of this neural network has been learned previously. As in the first embodiment, therefore, its sensitivity characteristic itself will not be partially discontinuous at the time of setting the throttle sensitivity Thg. With regard to the entire range of the vehicle speed V, therefore, it is possible to continuously control the driving power of the vehicle 1 over the entire range of the manipulation amount (acceleration stroke S) of the accelerator pedal 10 by the driver DR. When the driver DR continuously steps on the accelerator pedal, therefore, the acceleration of the vehicle 1 will not change abruptly and the vehicle speed V will always be increased smoothly.

Although only two embodiments of the present invention have been described herein, it should be apparent to those skilled in the art that the present invention may be embodied in many other specific forms without departing from the spirit or scope of the invention. Particularly, it should be understood that this invention may be embodied in the following forms.

This apparatus may be designed in such a way that, for the entire range of the acceleration stroke S, the vehicle speed V and the time series data of the acceleration stroke S are input to the neural network (first embodiment) or to the competitive learning neural network (second embodiment) to predict the requested acceleration, regardless of the value of the maximum acceleration stroke Smax. In this case, however, the normalization of the equation (2) will not be performed.

A driving source other than the engine and control amount changing means other than the throttle valve may be used as well. In an electrical automobile, for instance, the electric motor such as a DC motor, may be used as the driving source and a current control circuit or the like which control the current to the electric motor may be used as the control amount changing means.

The acceleration lever or another member may be used as the output manipulating means.

Instead of the acceleration sensor to detect the acceleration stroke S, a sensor for detecting the power of thrusting the accelerator pedal may be used, or this acceleration sensor and the thrust-power detecting sensor may be used together.

Further, the average stroke may be obtained from the time series data of the acceleration stroke S to be compared with the first predetermined value S1 or the second predetermined value S2. In this case, however, it is desirable that the first predetermined value S1 be set smaller than that of the above-described embodiments (e.g., "60%" of the allowable maximum stroke). It is also desirable that the second predetermined value S2 be set smaller than that of the above-described embodiments (e.g., "5%" of the allowable maximum stroke).

Although the time series data of the acceleration stroke S is used as an input of the requested acceleration predicting model in the above-described embodiments, the time series data of a change in acceleration stroke S may also be used or both may be used together.

Although the vehicle speed V after a predetermined time has elapsed since the start of the vehicle 1 is used as an input to the neural network in the individual embodiments, the vehicle speed at the start of the vehicle 1 or at the start of the driver's further stepping on the accelerator pedal may be used or both may be used.

The output value Gx may be set to more than three levels to provide finer prediction. Alternatively, the output value Gx may be set in two levels. Further, non-integer values between "−1" and "1" may be used as the output value Gx.

While the first embodiment is designed so that the throttle sensitivity Thg is computed from the equation (1), this invention may be modified so that the throttle sensitivity Thg is computed from the following equation (10). Analog values of "−1" to "1" with "0" in between may be used as the output value Gx at this time, as mentioned above.

$$Thg=Thgstd+Gx*k2 \quad (10)$$

where k2 is a positive constant which is "0.5" for example.

Even if the value computed in the above manner is set as the throttle sensitivity Thg, nearly the same function and advantages as obtained by the first embodiment will be provided.

In the second embodiment, the throttle sensitivity Thg is computed according to the equations (7) to (9). The throttle sensitivity Thg may however be computed from the following equation (11) or (12).

$$Thg=Thgstd+\alpha*k1 \quad (11)$$

$$Thg=(\text{current})Thgstd+\alpha*k2 \quad (12)$$

where α is "1" when the output pattern Gx is "$y_1$", is "0" when Gx is "$y_2$" and is "−1" when Gx is "$y_3$". In those equations, k1 is a positive constant which is "0.5" for example, and k2 is also a positive constant which is "0.1" for example.

Even if the value computed in the above manner is set as the throttle sensitivity Thg, nearly the same function and advantages as obtained by the second embodiment will be provided.

Therefore, the present examples and embodiment are to be considered as illustrative and not restrictive and the invention is not to be limited to the details given herein, but may be modified within the scope of the appended claims.

What is claimed is:

1. An apparatus for controlling the power output of a motor vehicle by predicting an amount of acceleration requested by an operator of said vehicle, and by computing and setting a throttle sensitivity for a throttle apparatus of a power source in said motor vehicle based on said predicted acceleration amount, said apparatus comprising:

means for detecting an amount by which said power source is throttled and for producing a throttle signal corresponding thereto;

means for manipulating the acceleration of said motor vehicle by the operator of said vehicle;

means for detecting the amount by which said acceleration manipulating means is manipulated and for producing a manipulated accelerator signal corresponding thereto;

means for detecting the speed of said vehicle and for producing a speed signal corresponding thereto;

means for processing said throttle, manipulated accelerator, and speed signals to predict a requested acceleration prediction model;

means for storing said throttle, manipulated accelerator, speed signals, and said requested acceleration prediction model;

means for computing a throttle sensitivity control value from said predicted requested acceleration model; and means for controlling said throttle apparatus based on said throttle sensitivity control value.

2. The apparatus according to claim 1, wherein said requested acceleration prediction model is updated by said processing means based on said throttle, manipulated accelerator, and speed signals.

3. The apparatus according to claim 1, wherein said power source is an engine, and wherein said throttle apparatus is a throttle valve provided in a throttle body of said engine.

4. The apparatus according to claim 3, wherein said acceleration manipulating means is an accelerator pedal manipulated by said operator.

5. The apparatus according to claim 1, wherein said processing, storing, computing, and controlling means are provided by a neuro computer.

6. The apparatus according to claim 1, wherein said computing means computes a throttle sensitivity control value (Thg) based on an equation where:

$$Thg=Thg_c-Gx*k1$$

where $Thg_c$ represents a current throttle sensitivity control value, Gx represents said requested acceleration predicting model, and where k1 is a constant.

7. The apparatus according to claim 1, wherein said computing means computes a throttle sensitivity value (Thg) based on an equation where:

$$Thg=Thgstd-Gx*k2$$

where Thgstd represents a preset throttle sensitivity reference value, Gx represents said requested acceleration predicting model, and where k2 is a constant.

8. The apparatus according to claim 1 wherein said controlling means further comprises means for computing said throttle sensitivity control value based on a throttle angle control program, said throttle signal and said manipulated accelerator signal.

9. The apparatus according to claim 1, wherein said controlling means further computes a target throttle sensitivity control value based on said throttle sensitivity control value and said manipulated accelerator signal such that said throttle sensitivity control value used to control said throttle apparatus equals said target throttle sensitivity control value.

10. The apparatus according to claim 1, further comprising means for forcibly setting said throttle sensitivity control amount to a maximum value in said computing means when said maximum value exceeds a first threshold value such that said computing means determines that the acceleration requested by said operator is large.

11. The apparatus according to claim 1, further comprising means for forcibly setting said throttle sensitivity control amount to a minimum value in said computing means when said minimum value does not exceed a second threshold value such that said computing means determines that the acceleration requested by said operator is small.

12. The apparatus according to claim 1, further comprising means for restricting said throttle sensitivity control value so that said throttle sensitivity control value does not exceed a predetermined value.

13. An apparatus for controlling the power output of a motor vehicle by predicting an amount of acceleration requested by an operator of said vehicle, and by computing and setting a throttle sensitivity for a throttle apparatus of a power source in said motor vehicle based on said predicted acceleration amount, said apparatus comprising:

means for detecting an amount by which said power source is throttled and for producing a throttle signal corresponding thereto;

means for manipulating the acceleration of said motor by the operator of said vehicle;

means for detecting the amount by which said acceleration manipulating means is manipulated and for producing a manipulated accelerator signal corresponding thereto;

means for detecting the speed of said vehicle and for producing a speed signal corresponding thereto;

means for processing and said throttle, manipulated accelerator, and speed signals to predict a requested acceleration prediction model representative of one from a plurality of acceleration patterns;

means for storing said throttle, manipulated accelerator, and speed signals, said acceleration patterns, and said requested acceleration prediction model;

means for computing a throttle sensitivity control value from said predicted requested acceleration model; and means for controlling said throttle apparatus based on said throttle sensitivity control value.

14. The apparatus according to claim 13, wherein said requested acceleration prediction model is updated by said processing means based on said throttle, manipulated accelerator, and speed signals.

15. The apparatus according to claim 13, wherein said power source is an engine, and wherein said throttle apparatus is a throttle valve provided in a throttle body of said engine.

16. The apparatus according to claim 15, wherein said acceleration manipulating means is an accelerator pedal manipulated by said operator.

17. The apparatus according to claim 13, wherein said processing, storing, computing, and controlling means are provided by a neuro computer.

18. The apparatus according to claim 13, wherein said computing means computes a throttle sensitivity control value (Thg) based on one from said plurality of acceleration patterns.

19. The apparatus according to claim 13, wherein said computing means computes said throttle sensitivity control value by changing a preset reference value for said throttle sensitivity control value corresponding to one of said acceleration patterns.

20. The apparatus according to claim 13 wherein said controlling means further comprises means for computing said throttle sensitivity control value based on a throttle angle control program, said throttle signal and said manipulated accelerator signal.

21. The apparatus according to claim 13, wherein said controlling means further computes a target throttle sensitivity control value based on said throttle sensitivity control value and said manipulated accelerator signal such that said throttle sensitivity control value used to control said throttle apparatus equals said target throttle sensitivity control value.

22. The apparatus according to claim 13, further comprising means for forcibly setting said throttle sensitivity control amount to a maximum value in said computing means when said maximum value exceeds a first threshold value such that said computing means determines that the acceleration requested by said operator is large.

23. The apparatus according to claim 13, further comprising means for forcibly setting said throttle sensitivity control amount to a minimum value in said computing means when said minimum value does not exceed a second threshold value such that said computing means determines that the acceleration requested by said operator is small.

* * * * *

UNITED STATES PATENT AND TRADEMARK OFFICE

CERTIFICATE OF CORRECTION

PATENT NO. : 5,454,358

DATED : October 3, 1995

INVENTOR(S) : Tatsuya HATTORI et al.

It is certified that error appears in the above-identified patent and that said Letters Patent is hereby corrected as shown below:

| Column | Line | |
|---|---|---|
| 1 | 17 | After "conditions" insert --,--. |
| 2 | 6 | Change "hers" to --her--. |
| 3 | 7 | Change "v.s." to --vs.--. |
| 3 | 22 | Change "v.s." to --vs.--. |
| 3 | 55 | Change "pivotable" to --pivotably--. |
| 5 | 61 | Change "Thg0" to --Thgø--. |
| 5 | 63 | Change "Thg0" to --Thgø--. |
| 5 | 66 | Change "Thg0" to --Thgø--. |
| 6 | 1 | Change "Thg0" to --Thgø--. |
| 6 | 9 | Change "Thg0" to --Thgø--. |

UNITED STATES PATENT AND TRADEMARK OFFICE

CERTIFICATE OF CORRECTION

PATENT NO. : 5,454,358

DATED : October 3, 1995

INVENTOR(S) : Tatsuya HATTORI et al.

It is certified that error appears in the above-identified patent and that said Letters Patent is hereby corrected as shown below:

| Column | Line | |
|---|---|---|
| 6 | 19 | Change "Thg0" to --Thgø--. |
| 6 | 22 | Change "Thg0" to --Thgø--. |
| 6 | 26 | Change "Thg0" to --Thgø--. |
| 6 | 29 | Change "Thg0" to --Thgø--. |
| 6 | 33 | Change "Thg0" to --Thgø--. |
| 8 | 17 | Change "(i)" to --(1)--. |
| 9 | 68 | After "small" delete "amount of". |
| 10 | 1 | Change "thrusting" to --push--. |
| 10 | 6 | Change "little" to --small--. |
| 10 | 7 | Change "thrusting" to --push--. |

UNITED STATES PATENT AND TRADEMARK OFFICE

CERTIFICATE OF CORRECTION

PATENT NO. : 5,454,358

DATED : October 3, 1995

INVENTOR(S) : Tatsuya HATTORI et al.

It is certified that error appears in the above-identified patent and that said Letters Patent is hereby corrected as shown below:

| Column | Line | |
|---|---|---|
| 10 | 47 | Change "mounting" to --hilly--. |
| 11 | 27 | Change "an" to --a--. |
| 12 | 6 | Change "...*k=,1,...*" to --...*k=1,2,...*--. |
| 12 | 7 | Change "...*k=,1,...*" to --...*k=1,2,...*--. |
| 12 | 9 | Change "$z_M$)" to --$z_{Mj}$)--. |
| 12 | 17 | Change "decent" to --descent--. |
| 12 | 37 | Change "v.s." to --vs.--. |
| 12 | 41 | Change "v.s." to --vs.--. |
| 17 | 46 | After "motor" insert --vehicle--. |
| 17 | 54 | Before "said" delete "and". |

Signed and Sealed this

Third Day of September, 1996

*Attest:*

*Attesting Officer*

BRUCE LEHMAN

*Commissioner of Patents and Trademarks*